US005671920A

United States Patent [19]

Acquaviva et al.

[11] Patent Number: 5,671,920

[45] Date of Patent: Sep. 30, 1997

[54] HIGH SPEED PRINTED SHEET STACKING AND REGISTRATION SYSTEM

[75] Inventors: Thomas Acquaviva, Penfield; William Brant; Randolph Cruz, both of Rochester, all of N.Y.

[73] Assignee: Xerox Corporation, Stamford, Conn.

[21] Appl. No.: 457,938

[22] Filed: Jun. 1, 1995

[51] Int. Cl.[6] ..... B65H 29/54

[52] U.S. Cl. ..... 271/307; 271/312; 271/182; 271/188; 271/197

[58] Field of Search ..... 271/307, 312, 271/182, 188, 197, 204, 209, 220, 900

[56] References Cited

U.S. PATENT DOCUMENTS

| | | | |
|---|---|---|---|
| 3,123,354 | 3/1964 | Ungerer | 271/197 |
| 3,328,027 | 6/1967 | Schmidtke | 271/197 |
| 3,905,487 | 9/1975 | Hoke et al. | 271/182 X |
| 4,157,177 | 6/1979 | Strecker | 271/197 |
| 4,436,301 | 3/1984 | Doery et al. | 271/177 |
| 4,971,304 | 11/1990 | Lofthus et al. | 271/227 |
| 5,172,904 | 12/1992 | Sze et al. | 271/187 |
| 5,397,120 | 3/1995 | Schulz et al. | 271/198 |

FOREIGN PATENT DOCUMENTS

| | | | |
|---|---|---|---|
| 1109130 | 4/1968 | United Kingdom | 271/197 |

OTHER PUBLICATIONS

Xerox Disclosure Journal vol. 7, No. 6, Nov./Dec. 1982 Author: Taylor, et al.

*Primary Examiner*—David H. Bollinger

[57] ABSTRACT

A sheet stacking and registration system particularly suited for high speed sequentially stacking of the flimsy printed sheets output of a high speed reproduction apparatus in a sheet stacking area, with a stacking registration position; with a vacuum belt sheet transport system acquiring only a limited lead edge area of the sheets and transporting them over the stacking area with non-slip sheet feeding towards the registration position; and an integral system peeling the lead edges of the sheets off of the vacuum transport and guiding them downwardly and towards the lead edge registration position while reducing but partially maintaining the sheet's vacuum acquisition, and applying a normal force, preferably with a roller pressing down the lead edges of the peeled off sheet against the previously stacked sheets adjacent the registration position, to frictionally slow the sheet as it approaches the registration position, and also holding down the sheet after it reaches the stacking position. The sheet transport may have spaced belt flights with spaced patterns of vacuum apertures spaced between substantially unapertured areas along the belts, and a synchronized belt drive to synchronously engage the lead edge areas of the incoming sheets. An upstream natural arcuate inversion path with a side registration system may be integrated therewith.

12 Claims, 8 Drawing Sheets

HIGH SPEED PRINTED SHEET STACKING AND REGISTRATION SYSTEM

Disclosed is an improved sheet stacking and registration system, especially for high speed printers or other reproduction apparatus.

The dependable and accurate stacking of the flimsy printed sheets being rapidly sequentially outputted by a high speed reproduction apparatus presents particular difficulties. High speed stacking systems have a tendency for catastrophic jams, with loss of job page order integrity, or even sheet ejection or damage. When sheets are being rapidly outputted closely following one another in time, there is insufficient settling time for sheets to settle normally by gravity onto the preceding sheets of the stack. There is also a tendency to lose lateral registration and have skewing or scattering of sheets in the stack, and thereby not provide square stacking. Furthermore, there is a tendency for the lead edge of the sheet, which is moving rapidly downstream, to bounce off of the edge or stopping system defining the registration edge of the stack. Additional sheet stacking problems are noted in Xerox Corporation U.S. Pat. No. 5,346,203, issued Sep. 13, 1994 to Denis Stemmle.

At sufficiently high rates of sheet speed, e.g., from roughly 120 sheets per minute to 180 sheets per minute and higher, there is an additional problem. An unconfined or uncontrolled sheet can actually "airplane". That is, the sheet is moving sufficiently rapidly that its aerodynamic properties can overcome gravitational forces and attempt to lift all or part of the sheet out of the movement path like a paper airplane.

All of these control and stacking problems are aggravated by any curls in the sheets. Sheet curls can interfere with stack settling, stack height control, and sheet control during feeding. Yet, sheet curl is common in reproduction apparatus, particularly those in which sheets are fused in a roll fuser (often only seconds before the sheets must be stacked in an output device, and/or finished) and/or or where more liquid or dry ink or toner is applied to one side of a sheet than the other. The latter is particularly a problem with multilayer color images. Although decurling devices are known for the output of sheets, they are usually not fully satisfactory and do not automatically accommodate all of the different variations in sheets, including differences in the initial humidity of the sheets, differences in sheet materials and thickness, differences in coatings or compositions of the sheets, differences in the amount of solid area coverage of the sheets, and whether the solid area occurs in the middle or at the edges of the sheet, differences in sheet cooling and humidity reabsorbtion after fusing, and duplex versus simplex printing, wherein the sheet is fused twice, and with variable delays between fusing passes.

Additional difficulties occur with the use of a "disk stacker" to also invert each sheet before it is stacked. In a disk stacker, the sheet is partially held in the arcuate slots of a rotating plural disk unit, as further described in references thereon such as in Xerox Corp. U.S. Pat No. 5,342,034 issued Aug. 30, 1994, especially starting at the bottom of Col. 22, including U.S. Pat. No. 5,090,683; 4,473,857; 4,473,857; 3,861,673; 4,830,356, and 5,145,168. Other disk stackers in general include, e.g., Xerox Corp. U.S. Pat. Nos. 5,377,965; 5,145,167; 5,172,904; 4,431,177; 5,058,880; etc.

High speed stacking with inversion is particularly difficult for thin and/or large flimsy paper sheets, where it is even more difficult to turn the sheet over rapidly and have the sheet settle on the top of the stack before the next sheet arrives. Even if an overlying transport belt system is provided to feed the trail edge of the sheet forward to assist its inversion and stacking (as shown in some of the above disk stacker references), the beam strength of such sheets is low and may not provide sufficient normal force against such upper transport belts, or stay in position in the disk slots. Also, if there is insufficient time between the settling of a sheet and the feeding in of the next sheet, there may be insufficient time for a side tamper to laterally tamp into position and/or offset the sheet as well.

Likewise, a conventional stacking system in which process direction registration is achieved by ejecting a sheet and then allowing it to slide downhill by gravity against a registration wall or edge stop engaging either its front (lead) or rear (trailing) edge (depending upon the direction of tray slope, as discussed in U.S. Pat. No. 5,346,203 cited above) is not suitable for really high speed sequential stacking. At high stacking speeds, such gravitational sheet registration and settling may not be achieved in this manner in time before the next sheet enters the tray, and the incoming sheet may strike and catch on the previous sheet.

By way of further background, it will be appreciated that the stacking or compiler shelf or tray on which the sheets are being stacked, in the disclosed embodiment or otherwise, is not necessarily fixed. That is, the compiler shelf plate may be one which is movable out from under the compiled set after stapling or other fastening and/or while the set is clamped, so as to allow the set to drop by gravity onto a stack therebelow. This is an alternative to or in addition to the stack elevator system disclosed in the embodiment hereinbelow Both are well known for high speed finishing. Examples of such removable or partial compiler shelves are disclosed in the 1988 U.S. Pat. No. 4,871,158 to Joe May, et al (D/78211CC) and U.S. Pat. No. 5,098,074 to Barry P. Mandel, assigned to Xerox Corp., Canon U.S. Pat. No. 5,137,265; and other references cited therein. Examples of elevator type stackers are described in Xerox Corp. U.S. Pat. No. 5,318,401 by Barry Mandel, and other art cited therein on high capacity stackers, and some other patents cited above. Such stacking systems can maintain a relatively constant stacking level. Of particular interest is the Xerox Corp. high speed "4135" printer output module, as disclosed for example in Xerox Corp. U.S. Pat. No. 5,172,904 issued Dec. 22, 1992 to C. Sze, et al. A similar stacking tray elevator system is disclosed in the example herein.

The embodiment disclosed herein overcomes many of the above-described and other sheet stacking and stack registration problems with a system providing much greater sheet control. The disclosed embodiment enables sheets to be rapidly received and stacked with accurate registration. The disclosed system eliminates the need for, and is believed to be an improvement over, previous types of stackers such as disk stackers or mechanically actuated knock down devices which must be operated for each incoming sheet. Although particularly suited for high speed printing applications, its use is not limited thereto. The basis stacking system disclosed herein provides a controlled system of acquiring, transporting and then releasing in a controlled manner, sheets from a special vacuum transport and stripping system. Optionally additionally disclosed in a desirable integrated manner is inversion of the output sheets prior to stacking. This is disclosed in a continuous and non sheet reversing controlled natural inversion manner.

Additionally disclosed in this embodiment is optional selectable lateral registration and/or lateral offset stacking of the output sheets being stacked. This lateral registration and/or offsetting system may be, as shown in FIGS. 1 and 2, integral the optional sheet inversion path to desirably provide said lateral offsetting while the sheets are in an arcuate path, thus, as is known, providing increased sheet beam strength, and also without interfering in any way with the stacking and process direction registration system disclosed herein.

Several other optional or additional features of the basic stacking and process direction (lead or trail edge) sheet stacking system disclosed herein are also disclosed.

Further by way of background, it is noted that a plural vacuum assisted drive belt system for transporting successive documents above a stacking tray, coordinated with a mechanical sheet knock-down bail system, is disclosed in Xerox Corporation U.S. Pat. No. 4,436,301 issued Mar. 13, 1984 to Michael S. Doery, et al. The present system does not require such a rapidly moving and critically coordinated knock-down system. An example of another type of high speed sheet stacking system is disclosed in a recent example in U.S. Pat. No. 5,397,120, issued Mar. 14, 1995 to Friedrich Schulz, et al, with belt conveyors. An example of another type of a fairly well-known document sheet registration system (which has also been used in similar configurations in sorter bins for stacking of sheets), is disclosed in Xerox Disclosure Journal, Vol. 7, No. 6, November/December, 1982, page 371–372 by Thomas Taylor, et al: "Document registration with a 'ski' assisted scuffer wheel".

Also by way of background, with regard to the optional sheet lateral or side registration system, the basic concept of using two differently driven varying speed or variable timing drive wheels with different motors (or clutches) on laterally spaced sides of the sheet path is known per se and is disclosed for example in Xerox Corporation U.S. Pat. No. 4,971,304 issued November 1990 to Lofthus, et al; U.S. Pat. No. 5,169,140 issued Dec. 8, 1992 to Stephen Wenthe; and U.S. Pat. 5,078,384 issued Jan. 7, 1992 to Steven Moore. Another type of side registration system which could be alternatively optionally used in cooperation with the disclosed stacking system, upstream thereof, during inverting, is that using corrugated angled or cross rolls, as described for example in Xerox Corporation U.S. Pat. No. 4,744,555, to Ray Naramore. Various other known sheet side registration or lateral shifting systems can be optionally utilized with the presently disclosed stacking and registration system.

A specific feature of the specific embodiments disclosed herein is to provide a sheet stacking and registration system with a sheet stacking area for sequentially stacking the flimsy printed sheets output of a reproduction apparatus being sequentially fed to said sheet stacking area, with an edge registration system defining a sheet lead edge stacking registration position; the improvement in high speed sheet stacking and registration with improved sheet control, comprising a vacuum belt sheet transport for vacuum acquiring a limited lead edge area of said sheets being fed to said stacking area and for transporting said acquired sheets over said stacking area, above sheets previously stacked therein, towards said sheet lead edge stacking registration position of said edge registration system; a sheet peeling system for peeling the lead edges of said sheets off of said vacuum sheet transport adjacent to said sheet lead edge stacking registration position and for guiding said peeled sheet lead edge downwardly and towards said registration position; said vacuum sheet transport automatically reducing said vacuum acquisition of said sheets as said sheets are being peeled off by said sheet peeling system; and a normal force system operatively associated with said sheet peeling system for pressing down the lead edges of said peeled off sheets against said previously stacked sheets in said sheet stacking area as the lead edges of said sheets reach said sheet lead edge stacking registration position.

Further specific features provided by the system disclosed herein, individually or in combination, include those wherein said vacuum belt sheet transport system continues to transport said sheets while reducing said vacuum acquisition thereof as said sheets are being peeled therefrom by said sheet peeling system so that at least partial feeding control is maintained over said sheets while said sheets are fed to said sheet lead edge stacking registration position; and/or wherein said sheets being sequentially fed into said sheet stacking area are fed thereto by an upstream sheet transport and edge registration system which laterally registers said sheets with a lateral sheet repositioning system before said sheets are acquired by said vacuum belt sheet transport; and/or wherein said vacuum belt sheet transport provides non-slip feeding maintaining registration of said sheets into said sheet peeling system; and/or wherein said sheet peeling system and said associated normal force system comprise plural pivotal sheet guide members with end rollers, said guide members operatively intersecting with said vacuum belt sheet transport at a stripping angle to strip said sheets from said vacuum belt sheet transport, said guide members providing a smooth sheet guide path thereunder from said vacuum belt sheet transport to said end rollers, said end rollers providing said normal force against said sheets to frictionally slow said sheets as they approach said stacking registration position, and said end rollers also providing said normal force to hold down said sheets after they reach said stacking registration position; and/or wherein said vacuum belt sheet transport comprises plural spaced parallel vacuum belt flights with overlying vacuum manifolds, said vacuum belts having patterns of vacuum apertures spaced between substantially unapertured areas along said belts so as to engage only sequential sheet lead edge areas; said belt vacuum apertures being operatively provided with a vacuum from said overlying vacuum manifolds for non-slip sheet feeding with said belts, and a synchronized drive system driving said belts to synchronously engage the lead edge areas of said sheets being sequentially fed to said sheet stacking area; and/or wherein said vacuum belt sheet transport automatically gradually decreases the area of vacuum acquisition of a sheet by said belt vacuum apertures during the time said sheet lead edge is being peeled from said vacuum belts by said sheet peeling system; and/or further including a movable sheet support guide system, movable partially over said sheet stacking area and partially under said vacuum belt sheet transport, upstream of said sheet peeling system, for at least partially supporting the trailing end areas of sheets being transported by said vacuum belt sheet transport by said limited lead edge areas of said sheets; and/or wherein said normal force system is integral said sheet peeling system, and said integral sheet peeling and normal force system is pivoted by gravity onto the top sheet of said sheet stacking area closely adjacent to said sheet lead edge stacking registration position; and/or wherein said integral sheet peeling and normal force system is pivotally mounted at its above said vacuum belt sheet transport, and has a pressing roller mounted at its opposing free end for pressing against the top sheet stacked in said sheet stacking area; and/or wherein said belts are concave relative to said acquired sheets to engage said acquired sheets at the outer edges of said belts, to provide a vacuum pocket between said belts and said acquired sheets, and to provide limited corrugation of said sheets; and/or wherein said vacuum belt sheet transport comprises plural spaced apart narrow, elongated endless vacuum apertured belts which interdigitate with said vertical registration wall below the top of said registration wall.

It is well known and commonplace to program and execute imaging, printing, document, and/or paper handling control functions and logic with software instructions for conventional or general purpose microprocessors. This is taught by various prior patents and commercial products. Such programing or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, the system or method may be implemented partially or fully in hardware, using standard logic circuits or a single chip using VLSI designs.

As shown in the art, the control of exemplary document and copy sheet handling systems in copiers and printers may be accomplished by conventionally actuating them by signals from the copier or printer controller directly or indirectly in response to simple programmed commands and from selected actuation or non-actuation of conventional switch inputs by the operator, such as switches selecting the number of copies to be made in that run, selecting simplex or duplex copying, selecting a copy sheet supply tray, etc. The resultant controller signals may conventionally actuate various conventional electrical solenoid or cam-controlled sheet deflector fingers, motors or clutches in the selected steps or sequences as programmed. Conventional sheet path sensors, switches or bails operatively connected to the conventional microprocessor controller may be utilized for sensing and timing the positions of copy sheets, as is well known in the art, and taught in the above and other patents and products.

In the description herein the term "sheet" refers to a usually flimsy physical sheet of paper, plastic, or other suitable physical substrate for images, whether precut or initially web fed. A "copy sheet" may be abbreviated as a "copy", or called "hardcopy". A "job" is normally a set of related sheets, usually a collated copy set copied from a set of original document sheets or electronic document page images, from a particular user, or otherwise related. A "simplex" document or copy sheet is one having its image and page number on only one side or face of the sheet, whereas a "duplex" document or copy sheet has "pages", and normally images, on both sides, i.e., each duplex document and copy is considered to have two opposing sides, faces, or "pages" even though no physical page number may be present.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of these embodiments thereof, including the drawing figures (approximately to scale) wherein:

Figure 9:
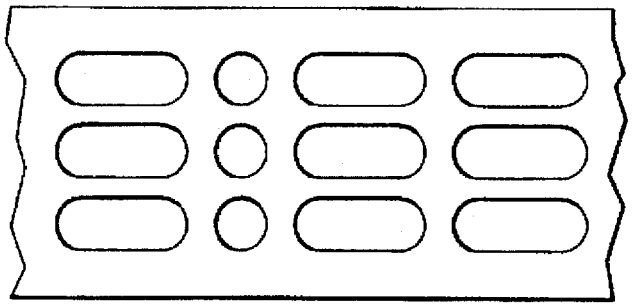
Figure 10:
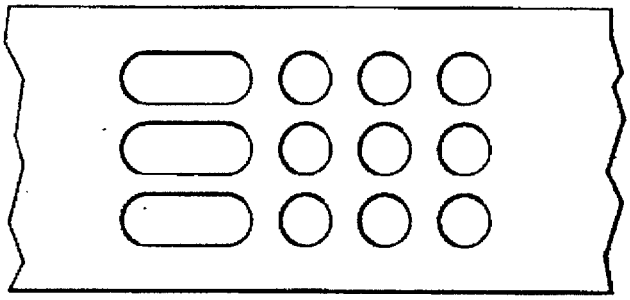
Figure 11:
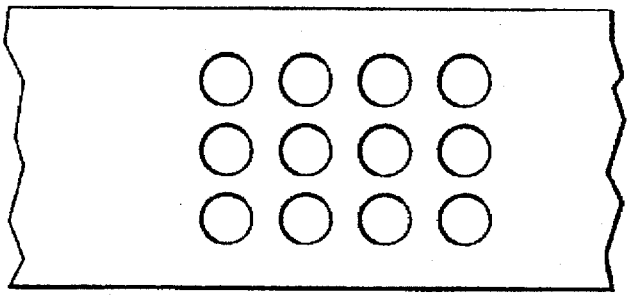
Figure 12:
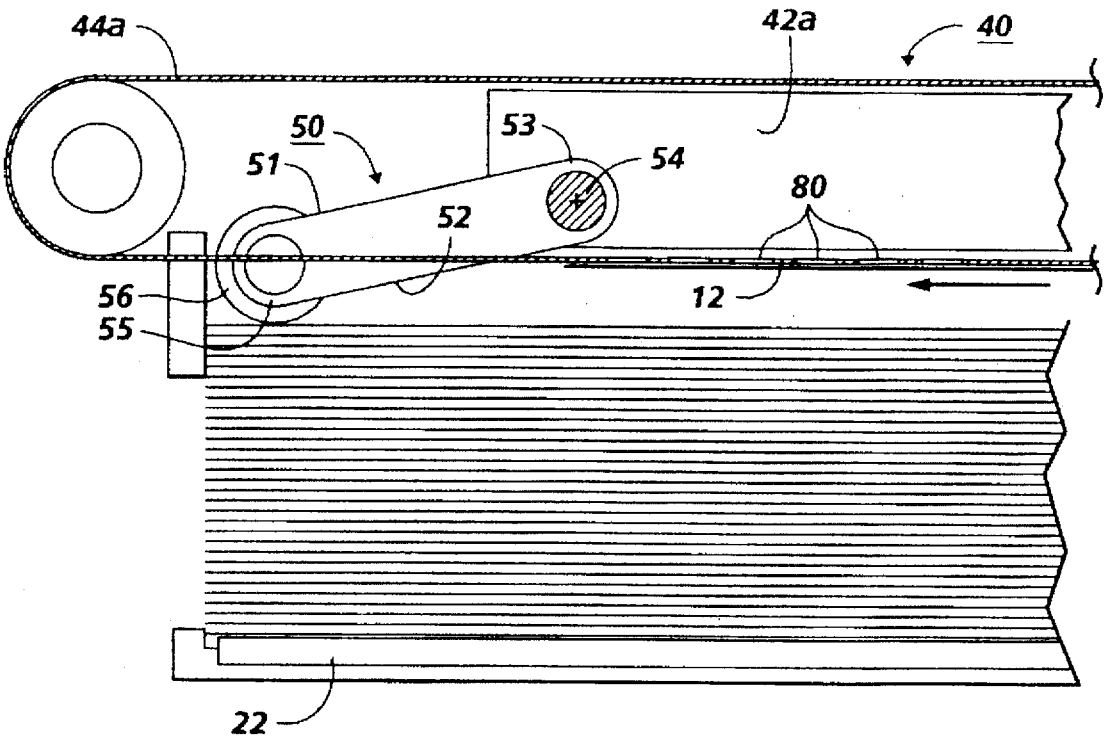
Figure 13:
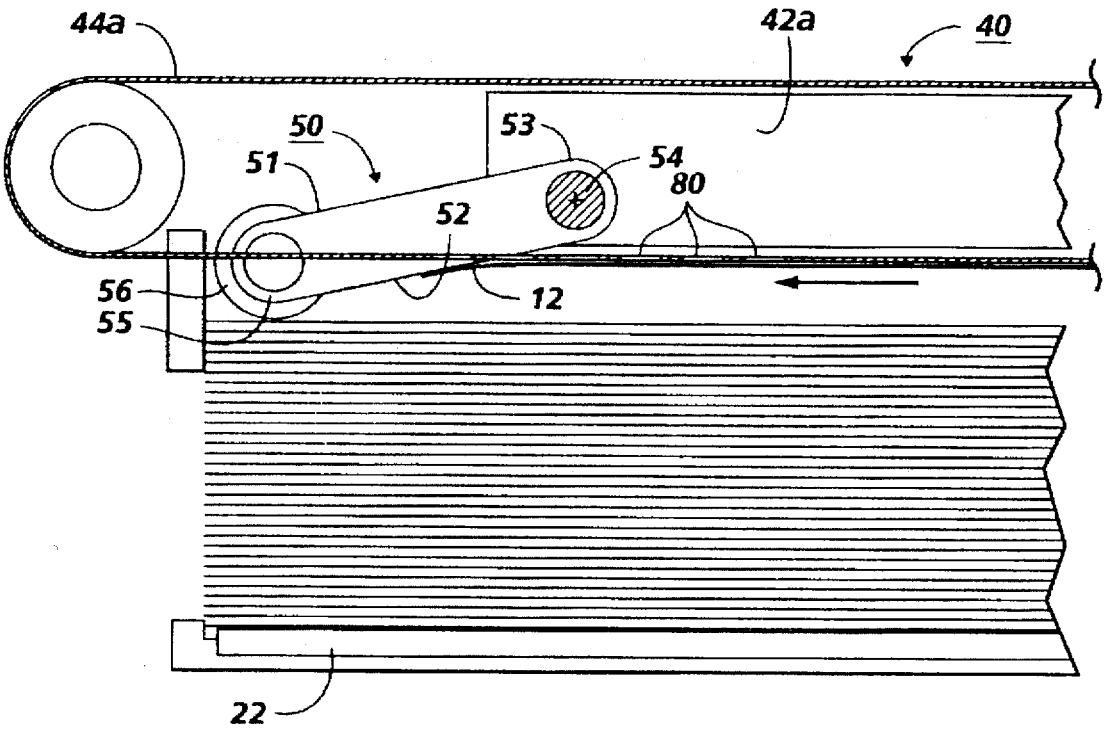
Figure 14:
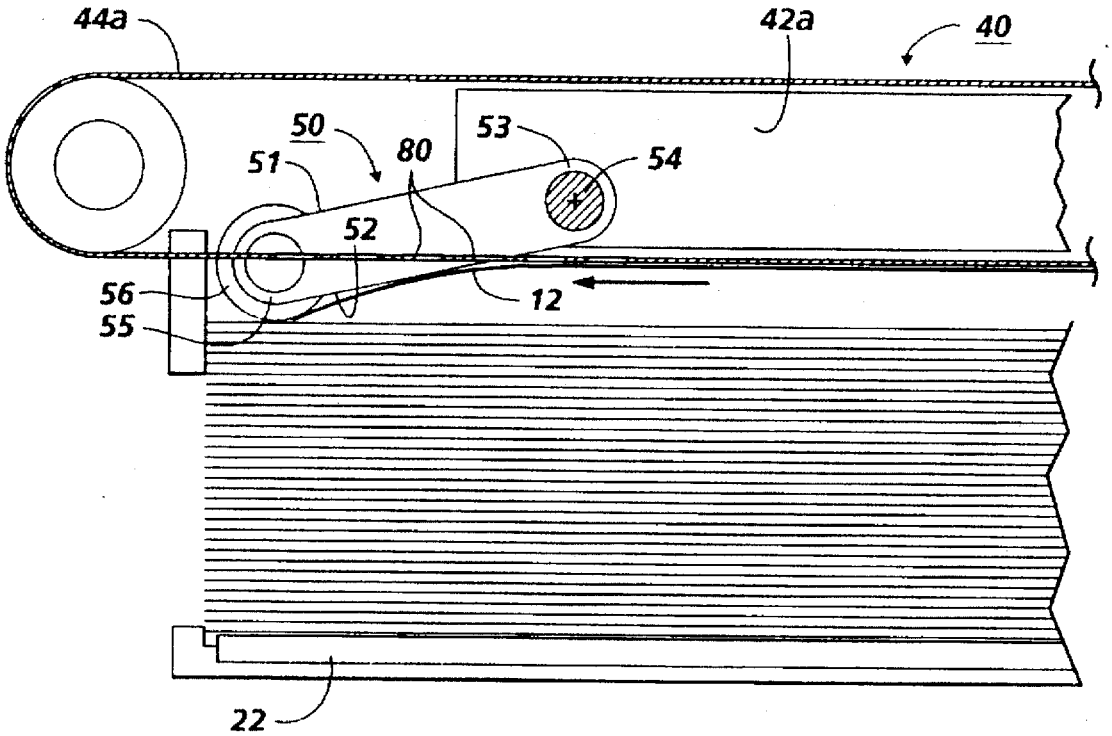
Figure 15:
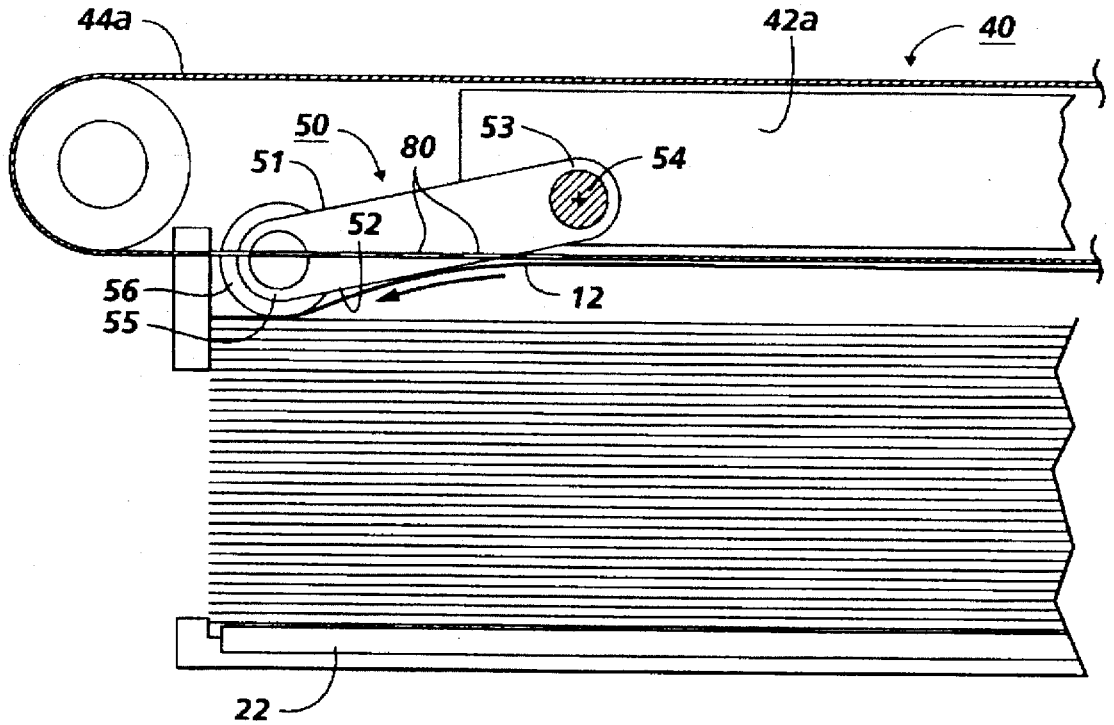

FIGS. 9, 10, and 11 represent three different hole pattern configurations. Each pattern has a different length and a different ratio of hole area exposed to the vacuum manifold per unit length of hole pattern (the length and ratio of hole area per unit length of the pattern influences the range of paper weights which can be transported without damage at the registration wall, and the pressure drop in the manifold); and FIGS. 12–15 are four identical enlarged front views of the stripping area of the embodiment of FIGS. 1–3, showing the sheet stripping operation in progressive stages as a sheet is being stripped, registered and stopped.

Figure 1:
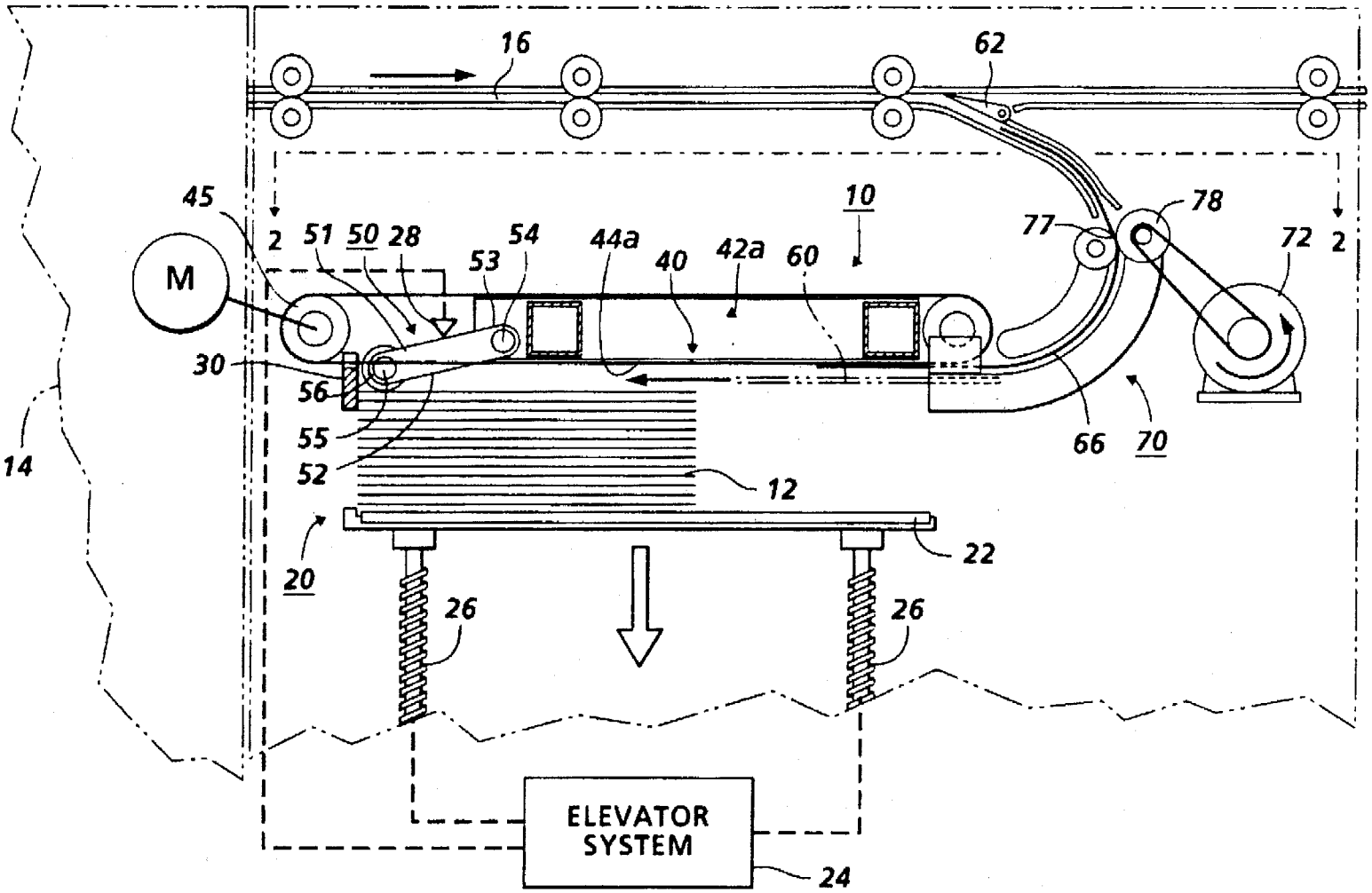
FIG. 1 is a partially schematic front view of one embodiment of the subject high speed sheet stacking and registration system.
Figure 2:
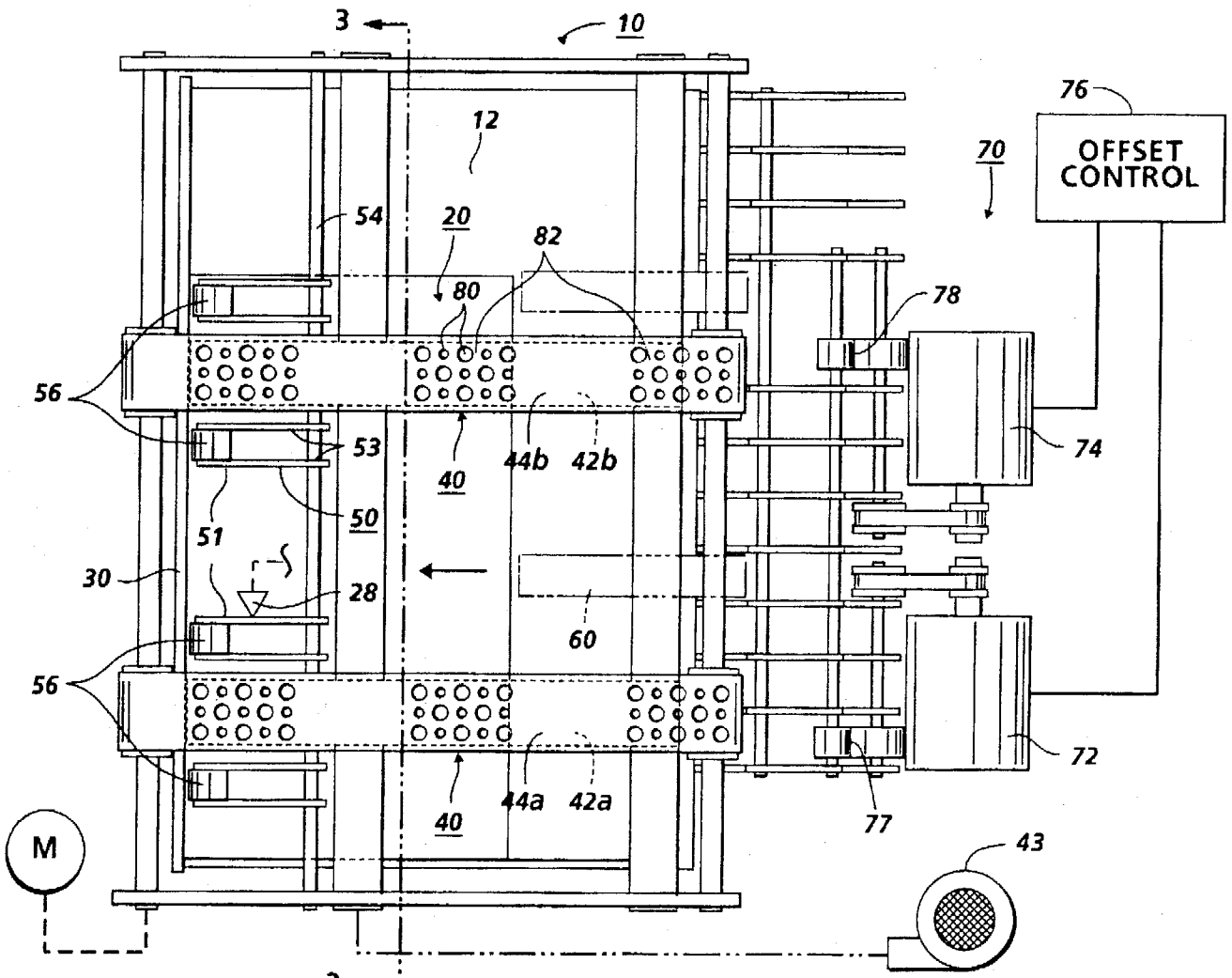
FIG. 2 is a top view of the embodiment of FIG. 1, taken along the line 2—2 of FIG. 1, and better illustrating an integral upstream sheet inverting and side or lateral registration system, shown here at the right hand side of FIGS. 1 and 2.
Figure 3:
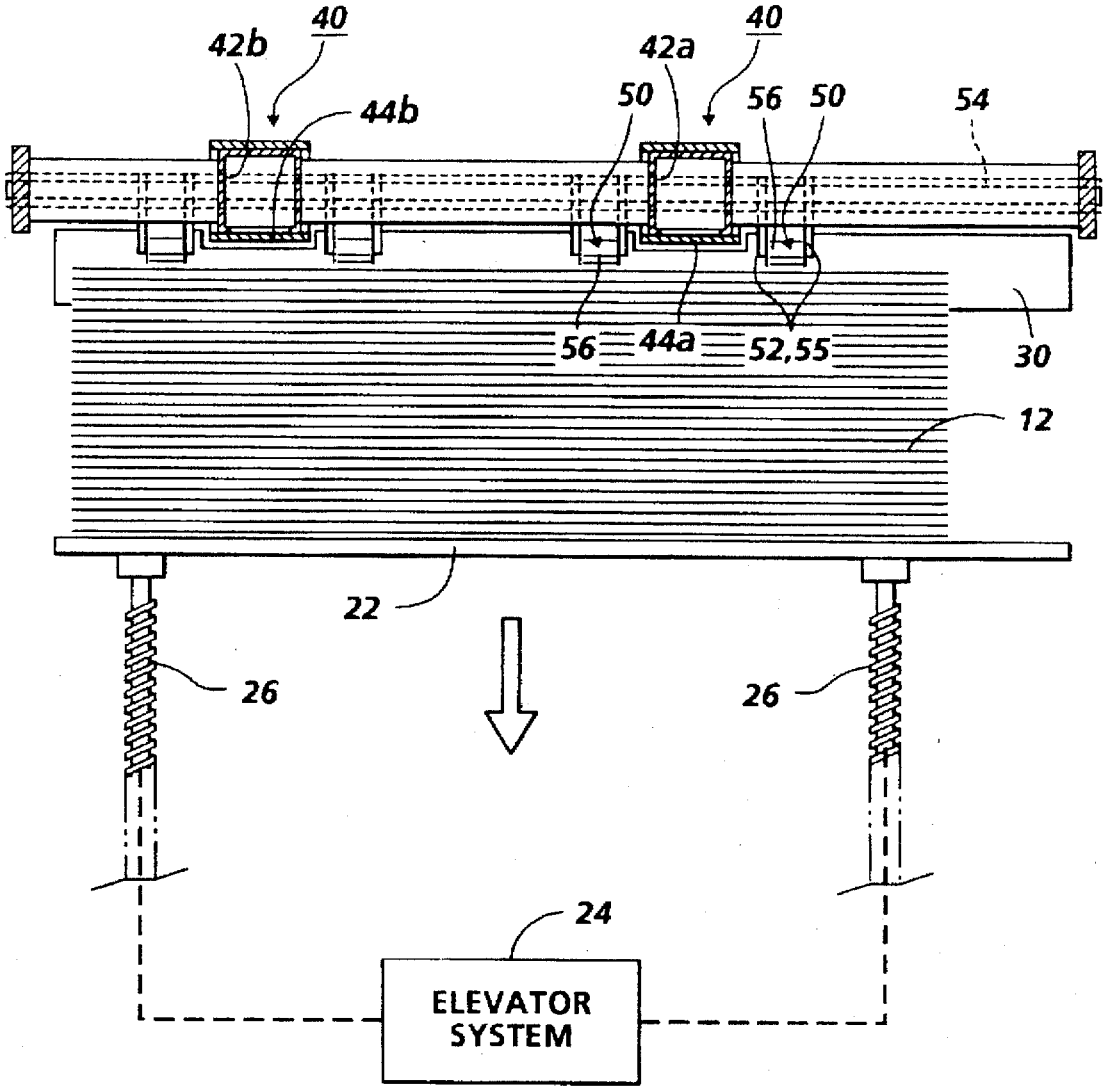
FIG. 3 is a rear side view of the embodiment of FIGS. 1 and 2 taken along the line 3—3 of FIG. 2.

Describing now in further detail the exemplary embodiments with reference to the Figures, there is illustrated in FIGS. 1–3 one example 10 of a sheet stacking and registration system, the operation of which is also illustrated in FIGS. 12–15.

As shown by the phantom outlines of FIG. 1, the system 10 may be part of a modular output unit adapted to receive the sequential output of printed sheets 12 from a reproduction machine 14. This can be a conventional xerographic or other high speed printer of various types, and need not be described herein. The sheets may be fed along an output path 16 as shown to a stacking area 20 inside this output module, or alternatively fed onto another such module, as will be further described below.

As noted above, previous examples of otherwise generally similar stacking modules are disclosed for example in said U.S. Pat. No. 5,172,904, etc., although the present system is not limited thereto. The particular such sheet stacking tray here in this example comprises an elevator tray 22 which is movable downwardly as stacks are accumulated so as to maintain a relatively constant stacking level at the top of the stack for the incoming further sheets to be stacked, as described in that U.S. Pat. No. 5,172,904 patent, and in various other such stacking systems. Here, this comprises an automatic elevator lowering system 24 utilizing commonly driven screw jacks such as 26, and a stack level switch 28, or the like, for controlling the elevator lowering system 24 by rotating the screw jacks 26 to maintain a substantially constant stacking level, by moving the elevator table 22 downwardly as the stack accumulates, and then moving the table 22 back up after the stacks are removed.

The rapidly sequentially incoming sheets 12 to be stacked in the stacking area 20 are fed over the top of the stack towards a sheet lead edge registration wall 30 by a vacuum belt sheet transport system 40. As a sheet 12 being transported by the vacuum belt system 40 approaches the lead edge registration wall 30, the sheet is peeled therefrom by a sheet peeling and normal force system 50, as will be further described. Vacuum is provided to the sheet transport system 40 by vacuum manifolds or channels 42*a* and 42*b*, here provided with vacuum by a conventional vacuum blower system 43 pneumatically connecting to the manifolds 42*a* and 42*b* by a cross manifold as illustrated, or any other suitable system. The manifolds 42*a*, 42*b* extend above and support the lower flights of the vacuum belts 44*a*, 44*b*, which are spaced apart transversely across the sheet path to provide nonskewing, non-slip feeding of the sheets 12 through vacuum apertures 80 such as are shown in FIG. 2, or the alternative belt configurations of FIGS. 4–11, or combinations of those features. The plural vacuum belts 44*a*, 44*b* here are commonly driven by a motor M on a common shaft mounting of driven end rollers 45 in this example so as to provide non-skewing feeding of the sheets acquired by this transport system 40. The motor M may be a conventional servo motor.

Figure 6:
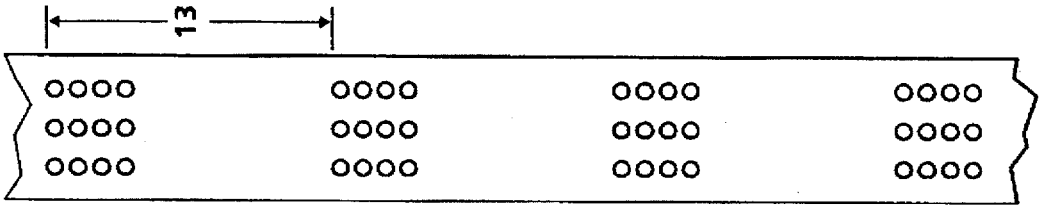
FIG. 6 represents a pattern of vacuum apertures for handling standard size sheets which are up to 8½ inches long in the process direction, with a gap of 4½ inches between sheets.

It will be noted from FIG. 2 and FIGS. 6–8 that the belt apertures are only in spaced apart aperture patterns, spaced along the belts, such as the aperture patterns 82 in FIG. 2. The vacuum belts are provided with such vacuum aperture areas in "pitches" corresponding to the dimensions of the sheets to be fed in their sheet transporting direction. This is because the sheets 12 are transported here by vacuum adhesion only of a lead edge area of each sheet. The spacing between vacuum aperture areas along the belt is thus set for the dimension of sheets to be fed in their process direction. FIG. 6 shows a preferred vacuum aperture pattern with hole patterns spaced 13 inches apart. With this hole pattern, the "length" of the fed sheet is the standard 8.5 inches and there is 4.5 inches between sheets. A 17 inch sheet would cover two succeeding such hole patterns. When a 17 inch sheet reached the registration wall, the lead edge would peel off but the second hole pattern would continue to push the trailing edge of the sheet forward, causing the sheet to buckle and jam under the weighted roller. In machines which are intended to handle both 8½ and 17 inch sheets, the dual pitch belt shown in FIG. 7 would be an alternate configuration. A two part manifold would be provided. Each part of the manifold would be connected to a different fan, or shunted to a single fan input via a solenoid operated valve (not shown). The belts shown in FIG. 7 have hole patterns to acquire and transport the lead edge of each sheet on either the right or left edges of the belt. When transporting 8½ sheets, the left side of the manifold is turned off and sheets are acquired at every hole pattern on the right side of the belt. The hole patterns are 12 inches apart and 8½ inch sheets can be acquired and driven to the registration wall. The intersheet gap here is 3½ inches. When operating with 17 inch papers, the right side of the manifold is turned off and sheets are acquired at every hole pattern on the left side of the belt. The hole patterns are 24 inches apart and 17 inch sheets are acquired and driven to the registration wall where they are released without being buckled. The intercopy gap here is 7 inches.

Figure 8:
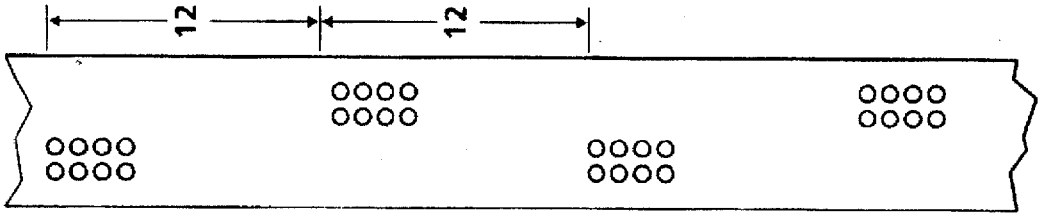
FIG. 8 represents an alternate pattern to FIG. 7.
Figure 7:
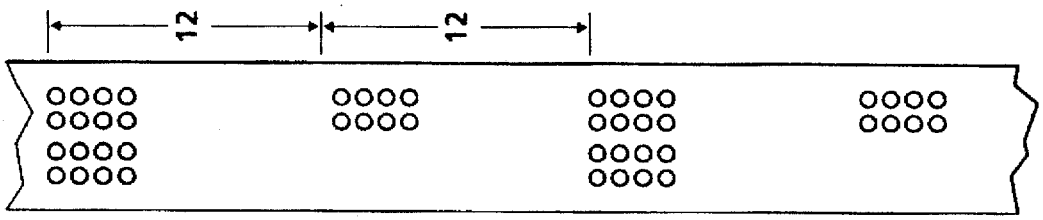
FIG. 7 represents an alternate pattern for handling sheets which are either up to 8½ inches long or up to 17 inches long, by the shorter sheets being transported by hole patterns along one side of the belt and the longer sheets by hole patterns along the other side of the belt.

Another configuration of belts is shown in FIG. 8. These belts have alternate hole patterns 12 inches apart on either edge of the belt. When operating with 17 inch sheets, vacuum pressure on the right side of the manifold is turned off and sheets are acquired by the 24 inch spaced holes on the left side of the belt. When operating with 8½ sheets, both sides of the manifold are evacuated and sheets are acquired and driven forward by the alternating hole patterns on either edge of the belt.

The incoming sheets must be synchronized to meet up with the positions of these belt apertures such as by the drive motor M for the belts. Alternatively or additionally, there can be synchronism of a fixed drive of the vacuum belts 44*a*, 44*b* with upstream variable drives and sheet path sensors for locating and timing the position of incoming sheets thereto, in a known manner.

As the lead edge area of each sheet 12 enters the stacking area 20, it is thus vacuum acquired by a vacuum aperture pattern 82 of both belts 44*a*, 44*b* and vacuum adhered to both belts. The vacuum belt transport system 40 thus moves the sheet rapidly over the previously stacked sheets, above the sheets by a substantial spacing of the belt 44*a*, 44*b* lower flights above the top of the stack, as illustrated. Thus, even if there is some sagging or drooping of the remainder of the sheet, it is normally not being dragged with any significant frictional force over the preceding top sheet in the stack in most cases. (As will be described below, an additional sheet trailing end support can be provided for particularly large sheets, if needed.)

As the incoming sheet 12 now approaches, with high speed, the lead edge registration wall 30, it is still firmly adhered without slippage to the vacuum belts 44*a*, 44*b*. There is provided here a system 50 for automatically stripping off and controlling the lead edge of the sheet for stacking registration, including slowing the sheet down just before its impact with the registration wall 30, so that the sheet lead edge will not be damaged or bounce away from the registration wall due to a high speed impact. (Those are problems in the prior art, as discussed above.) This is overcome here by a sheet peeling and normal force system 50, as will be described.

As shown in the examples of FIGS. 1–3 and especially 12–15, this sheet peeling and normal force system 50 may be a simple, integral, yet automatically self-compensating system which cooperatively interacts with the vacuum belt system 40. In this example, the system 50 comprises plural independent stripper and wheel units 51, which are each pivotally mounted closely adjacent to, and on opposite sides of, the belts 44*a*, 44*b*, and adjacent to the sheet lead edge registration wall 30. Each stripper unit 51 has a predetermined low impact angle lower sheet guide surface 52 extending from above to below the level or plane of the lower flights of the vacuum belts 44*a*, 44*b*. As a sheet 12 approaches the unit 51, the lead edge of the sheet strikes these guide surfaces 52, which surfaces 52 guide and pulls the lead edge of the sheet away from the vacuum belts 44*a*, 44*b* and directs the lead edge of the sheet downwardly toward the top of the sheet stack. These guide surfaces 52 extend continuously and smoothly down from the point of impact of the sheets in the plane of the vacuum belts 44*a*, 44*b* to closely adjacent the stacking level.

Each unit 51 here is also freely pivotally mounted at its upper or pivot end 53 to a pivot support rod 54 above this vacuum belt sheet transport plane. The opposite or free end of each unit 51 is a wheel end 55, which mounts a weighted roller or wheel 56. The entire unit 51 is thus gravity loaded against the top of the stack with the rollers 56 resting upon the top sheet of the stack with a predetermined weight built into the unit 51 and its end roller 56. This weight is designed to provide a predetermined normal force.

As the sheet 12 being peeled off slides down the guide surfaces 52 of the stripper units 51, it is driven under the rollers 56 and onto the top of the stack in its final movement towards the closely adjacent end stop at the registration wall 30. This not only holds down the lead edge of the sheet flatly against the top of the stack (in spite of any curl in the sheet), it also provides inter-sheet friction due to this normal force pressing down the incoming sheet lead edge against the previous sheet on the top of the stack. This helps reduce the sheet velocity and to prevent "bounce back" as the lead edge of the sheet strikes the registration wall 30. The rollers 56 are smooth and freewheeling, to provide normal force without forward sheet feeding resistance thereunder. The wheel 56 tangent transitions smoothly from the guide surface 52, so the surface 52 guides the sheet lead edge directly under the wheel surface.

There is an automatic reduction of the vacuum adhesion of the vacuum belts 42*a*, 42*b* to the incoming sheet during the above-described sheet stripping process. Referring especially to FIGS. 12–15, which shows four stages of the stripping, the vacuum belt sheet transport system 50 continues to apply vacuum adhesion driving force on the lead edge area of the sheet as it is being stripped, but with decreasing vacuum area engagement and drive force as the stripping continues. This is provided for by the area (extending along the belt) of the vacuum apertures 80 in the pattern 82. It may be seen that the area of the vacuum aperture patterns 82 extend along the belts 44*a*, 44*b* is in pattern dimensions corresponding roughly to the sheet stripping distance along the stripper guide surfaces 52. Accordingly, even after the initial lead edge area of the sheet has been stripped away from the vacuum belts, there is still a small remaining portion of the lead edge area of the sheet 12 which is still engaged and fed forward by some few remaining apertures 80 of the same aperture pattern 82 as the lead edge of the sheet approaches registration. This ensures that the sheet is still being at least partially driven forward during stripping and registration.

However, it may also be seen that once the stripping and registration process has been completed, with the lead edge of the sheet abutting the registration wall 30, that all, or substantially all, of the vacuum apertures 80 of that particular aperture pattern 82 will have passed the point of intersecting engagement with the stripper guide surfaces 52, and thus the sheet 12 is no longer being driven forward by any vacuum or frictional force thereon. Thus, there is no tendency to buckle or fold any of the remaining area of the sheet, because there is no forward driving force on any part of the stacked sheet. The sheet 12 is completely released at that point from the vacuum transport system 40.

Likewise, there is no resistance to the settling of the trail edge portion of the sheet onto the top of the stack. In fact, since only the lead edge area of the sheet was captured by vacuum apertures 80, and no downstream area of the sheet is engaged by any vacuum apertures here, the trailing portion of the sheet may have already dropped or settled on top of the stack by the time the leading edge of the sheet has been positively fed down and into engagement with the registration wall 30 at the downstream end of the stack.

There is no settling required at all for the lead edge area of the sheet. With the present system, each sheet of paper's lead edge is positively clamped down on top of the stack without any settling time delays or any curled paper effects. No positive air pressure is required anywhere in this system, for sheet settling, for removal of sheets from the vacuum transport, or otherwise. The incoming sheet is not blown off, nor does it require a scuffer sled or a mechanical knockdown system, or any other critically actuated timing system. No moving mechanism is required other than a very slight passive pivoting movement of the stripping arm units 51, and rotation of their rollers 56 at the outer ends 55 thereof. (In some cases, the rollers 56 do not even need to rotate.) All of that is accomplished by the incoming sheet movement itself, without any requirement of any drive or mechanism.

As noted above, for exceptionally large or flimsy sheets, there is disclosed herein an optional additional feature, of movable sheet end supports 60, which can be axially or pivotally temporarily inserted between the top of the sheet stack and the plane of the transporting belt flights 44*a*, 44*b* in the rear or upstream portion of the stacking area 20, so as to hold up the trailing portions of such a special sheet which might otherwise exert excessive frictional drag on the previous top sheet of the stack. The movable end supports 60 may be effectively "swing arm guides" which swing in to prevent the incoming lead edge of the next sheet from jamming into the trail edges of previous sheets that have not fully settled out of the path of the incoming sheet lead edge.

Turning now to the additional integral upstream feeding and inverting and lateral registration system 70 illustrated here, the incoming sheets in the sheet output path 16 may be gated from that output path 16 by a conventional deflector finger gate 62 or the like, in order to be stacked by the system 10. Alternatively, if the gate 62 is down or out of the output path 16, the sheets may be fed directly on to a subsequent such module, or on to an output stacking tray without inversion, a purge tray, a bookbinder or other finisher, or the like. It will be appreciated, however, that integral finishing may also be provided in the stacking and registration system 10 itself, if desired.

In the upstream feeding and registration system 70 here, a natural arcuate inversion path 66 is provided to turn over the sheets in a semi-cylindrical path, so that they may be stacked inverted from their original output orientation from the reproduction machine 14, as is often desired. This natural or unidirectional arcuate inversion path 66 with a large radius provides a low jam rate as compared to inverters which require rapidly reversing the direction of motion of a sheet and changing its lead to trail edge position and path direction. Such inverters must rapidly decelerate and reaccelerate the sheet, since they are not unidirectional. That has disadvantages, such as potentially inducing sheet skew and/or skippage, etc. Here, the sheet 12 continues in its same direction of movement at the same basic high velocity, yet is effectively inverted.

The arcuate inversion path 66 here desirably provides an additional integral function, of sheet lateral registration and/or offsetting, utilizing the lateral offset drive system 70. The system 70 here comprises independent servo motors 72 and 74 driving opposite sides of the sheet 12 by the illustrated drive roller nips 77, 78 in the inversion path 66. This allows deskewing and lateral registration of the sheet to be done in a known manner, illustrated here by the offset control 76 shown in FIG. 2 differently driving the two servo motors so as to achieve deskew and registration as the sheets pass through their respectively driven roller nips 77, 78, as described, for example, in the above-cited U.S. Pat. Nos. 4,971,304, 5,169,140, or 5,078,384. This electronically controlled nip pair 77, 78 "steers" the sheet to one side or the other for electronic offsetting as well as deskewing of the sheet. In addition, these electronically controlled nips 77, 78 can provide lead edge timing in the process direction of the sheet (speedup or slowdown) to coincide with the arrival of one of the three or more pitched areas of hole patterns in the vacuum transport belts 44*a*, 44*b* at the output of system 70.

Conventional sheet edge position path sensors (not shown) may be used in conjunction therewith. As indicated above, this is merely one form of such optional side or lateral registration system which can be utilized here. Such side registration is desirably done while the sheet is in such an arcuate path such as 66 here, since this provides substantially increased beam strength for the sheet, improving the lateral registration capability.

Thus, the sheets 12 can enter the stacking and process direction registration system 10 from the system 70 already correctly laterally positioned and deskewed. The non-slip transport system 40 then maintains this proper orientation of the sheets so that deskewing does not have to be done by impact of the lead edge of the sheet at an angle with the registration wall 30, as in many other stacking systems. That would be particularly undesirable for high speed stacking, because the sheet lead edge would concentrate its impact force on one corner of the sheet, which can damage it, rather than uniformly spreading the lead edge impact force along the sheet lead edge.

Furthermore, the lateral offset and drive system 70 here can provide deliberately different lateral positioning of incoming sheets, so that different job sets can be stacked laterally offset from one another on the table 22. Such lateral offsetting of job sets is well known and desirable for customer job separation and distinction. Providing such lateral offsetting upstream eliminates any need for tamping of sheets within the stacking area, which could interfere with other registration and stacking requirements.

It may be seen that with the present systems, that all incoming sheets are rapidly acquired, transported, and released at registration while maintained under positive control and handling.

It will also be noted from FIGS. 1 and 3 that the lower flights of the vacuum transport belts **44*a*, 44*b* here extend through notches in the registration wall 30. That is, the belts interdigitate with this wall 30 so as to ensure that the sheet cannot extend above the top of the registration wall 30** and escape thereover.

Figure 4:
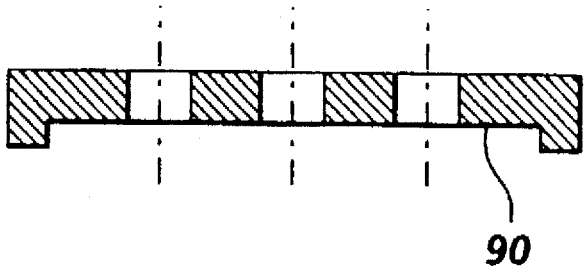
FIG. 4 shows an alternative vacuum belt, in cross section, for the embodiment of FIGS. 1–3, with a relieved or grooved 90 center area (raised edges), for slight corrugation of transported sheets vacuum adhered thereto.
Figure 5:
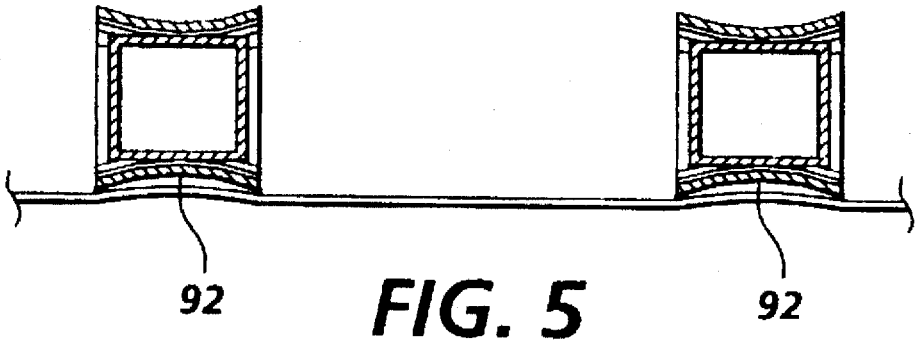
FIG. 5 is another alternative vacuum belt transport system for the embodiment of FIGS. 1–3, with curved, concave, belt supports 92 on the vacuum manifolds to provide sheet corrugation.

The belt configurations of the belts of FIGS. 4 and 5 provide corrugation at 90 or 92 along the sheet 12 to add some beam strength to the sheet in its transporting direction and thereby help hold up the upstream portions of the sheet which are not vacuum supported. In one configuration, the upper and lower flights of the belt would be flat and would acquire and transport the sheet as described. In an alternate configuration, the upper and lower flights of the belt would be slightly curled in the lateral direction. This curvature serves two purposes. It imparts a slight corrugation to the sheet transverse to the direction of motion which strengthens the sheet and helps drive it to the registration wall. Also, the curvature helps hold the sheet to the belt by creating a vacuum pocket between the acquired sheet and the belt. This pocket of low pressure air originates at the hole pattern in the belt at the lead edge and extends to the trailing edge of the sheet. This negative pressure in the pocket terminates when the belt holes pass the end of the manifold, thus releasing the sheet.

In summary, with the system 10, it can be seen that the incoming sheets 12 are gently peeled by the ramps 52 and rollers 56 system from the incoming sheet vacuum transport belts **44*a*, 44*b*, while the remaining vacuum port area 82 engaging the sheet is being automatically reduced. This provides gradual reduction of the sheet drive adjacent the registration edge, yet the sheet removal from the vacuum transport belts is passive here, and the weighted rollers 56 also prevent bounceback when the lead edge of the sheet strikes the registration wall. The lead edge of each incoming sheet is positively fed all the way to directly on top of the sheet stack at the registration position, rather than flying and/or falling into place. The next sheet may be immediately acquired upstream and be fed over the stacking area towards the same registration position even before the prior sheet is registered. The final decelaration of the sheet is assisted by the disclosed passive, non-obstructive applied normal force by the weighted rollers 56** (which may alternatively be spring-loaded rather than weight-loaded, of course).

While the embodiments disclosed herein are preferred, it will be appreciated from this teaching that various alternatives, modifications, variations or improvements therein may be made by those skilled in the art, which are intended to be encompassed by the following claims:

What is claimed is:

1. In a sheet stacking and registration system with a sheet stacking area for sequentially stacking the flimsy printed sheets output of a reproduction apparatus being sequentially fed to said sheet stacking area, with an edge registration system defining a sheet lead edge stacking registration position; the improvement in high speed sheet stacking and registration with improved sheet control, comprising:

a vacuum belt sheet transport for vacuum acquiring a limited lead edge area of said sheets being fed to said stacking area and for transporting said acquired sheets over said stacking area, above sheets previously stacked therein, towards said sheet lead edge stacking registration position of said edge registration system;

a sheet peeling system for peeling the lead edges of said sheets off of said vacuum sheet transport adjacent to said sheet lead edge stacking registration position and for guiding said peeled sheet lead edge downwardly and towards said registration position;

said vacuum belt sheet transport has a belt vacuum aperture pattern for reducing said vacuum acquisition of said sheets as said sheets are being peeled off by said sheet peeling system; and a normal force system operatively associated with said sheet peeling system for pressing down the lead edges of said peeled off sheets against said previously stacked sheets in said sheet stacking area as the lead edges of said sheets reach said sheet lead edge stacking registration position.

2. The sheet stacking and registration system of claim 1, wherein said vacuum belt sheet transport system continues to transport said sheets while reducing said vacuum acquisition thereof as said sheets are being peeled therefrom by said sheet peeling system so that at least partial feeding control is maintained over said sheets while said sheets are fed to said sheet lead edge stacking registration position.

3. The sheet stacking and registration system of claim 1, wherein said sheets being sequentially fed into said sheet stacking area are fed thereto by an upstream sheet transport and edge registration system which laterally registers said sheets with a lateral sheet repositioning system before said sheets are acquired by said vacuum belt sheet transport;

and wherein said vacuum belt sheet transport provides non-slip feeding maintaining registration of said sheets into said sheet peeling system.

4. The sheet stacking and registration system of claim 1, wherein said sheet peeling system and said associated normal force system comprise plural pivotal sheet guide members with end rollers, said guide members operatively intersecting with said vacuum belt sheet transport at a stripping angle to strip said sheets from said vacuum belt sheet transport, said guide members providing a smooth sheet guide path thereunder from said vacuum belt sheet transport to said end rollers, said end rollers providing said normal force against said sheets to frictionally slow said sheets as they approach said stacking registration position, and said end rollers also providing said normal force to hold down said sheets after they reach said stacking registration position.

5. The sheet stacking and registration system of claim 1, wherein:

said vacuum belt sheet transport comprises plural spaced parallel vacuum belt flights with overlying vacuum manifolds, said vacuum belts having said pattern of vacuum apertures spaced between substantially unapertured areas along said belts so as to engage only sequential sheet lead edge areas, said belt vacuum apertures being operatively provided with a vacuum from said overlying vacuum manifolds for non-slip sheet feeding with said belts, and a synchronized drive system driving said belts to synchronously engage the lead edge areas of said sheets being sequentially fed to said sheet stacking area.

6. The sheet stacking and registration system of claim 5, wherein said vacuum belt sheet transport automatically gradually decreases the area of vacuum acquisition of a sheet by said belt vacuum apertures during the time said sheet lead edge is being peeled from said vacuum belts by said sheet peeling system.

7. The sheet stacking and registration system of claim 1, further including a movable sheet support guide system, movable partially over said sheet stacking area and partially under said vacuum belt sheet transport, upstream of said sheet peeling system, for at least partially supporting the trailing end areas of sheets being transported by said vacuum belt sheet transport by said limited lead edge areas of said sheets.

8. The sheet stacking and registration system of claim 1, wherein said normal force system is integral said sheet peeling system, and said integral sheet peeling and normal force system is pivoted by gravity onto the top sheet of said sheet stacking area closely adjacent to said sheet lead edge stacking registration position.

9. The sheet stacking and registration system of claim 8, wherein said integral sheet peeling and normal force system is pivotally mounted at one end above said vacuum belt sheet transport, and has a pressing roller mounted at its opposing free end for pressing against the top sheet stacked in said sheet stacking area.

10. The sheet stacking and registration system of claim 1, wherein said vacuum belt sheet transport comprises plural spaced apart narrow elongated endless belts, having said vacuum aperture patterns spaced apart in said elongated dimensions, and wherein said belts are concave relative to said acquired sheets to engage said acquired sheets at the outer edges of said belts, to provide a vacuum pocket between said belts and said acquired sheets, and to provide limited corrugation of said sheets.

11. The sheet stacking and registration system of claim 1, wherein said vacuum belt sheet transport comprises plural spaced apart narrow, elongated endless said vacuum aperture pattern belts, and wherein said edge registration system comprises a substantially vertical registration wall, and wherein said plural vacuum apertured belts of said vacuum belt sheet transport interdigitate with said vertical registration wall below the top of said registration wall.

12. The sheet stacking and registration system of claim 1, wherein said vacuum belt sheet transport comprises plural spaced parallel vacuum belt flights with overlying vacuum manifolds, said vacuum belts having patterns of vacuum apertures spaced between substantially unapertured areas along said belts so as to engage only sequential sheet lead edge areas, said belt vacuum apertures being operatively provided with a vacuum from said overlying vacuum manifolds for non-slip sheet feeding with said belts, and a synchronized drive system driving said belts to synchronously engage the lead edge areas of said sheets being sequentially fed to said sheet stacking area, and wherein said sheet peeling system and said associated normal force system comprise plural pivotal sheet guide members with end rollers, said guide members operatively intersecting with said vacuum belt sheet transport at a defined stripping angle to strip said sheets from said vacuum belt sheet transport, said guide members providing a smooth sheet guide path thereunder from said vacuum belt sheet transport to said end rollers, said end rollers providing said normal force against said sheets to frictionally slow said sheets as they approach said stacking registration position, and said end rollers also providing said normal force to hold down said sheets after they reach said stacking registration position, and wherein said vacuum belt sheet transport automatically gradually decreases the area of vacuum acquisition of a sheet by said vacuum belt apertures during the time said sheet lead edge is being peeled from said vacuum belts by said sheet peeling system, so that said sheet transport system continues to transport said sheets while reducing said vacuum acquisition thereof as said sheets are being peeled therefrom by said sheet peeling system so that at least partial feeding control is maintained over said sheets while said sheets are fed up to said sheet lead edge stacking registration position.

* * * * *